United States Patent [19]

Tucker et al.

[11] Patent Number: 4,937,976

[45] Date of Patent: Jul. 3, 1990

[54] WINDOW OPERATOR AND HINGE STRUCTURE

[75] Inventors: Daniel G. Tucker, Elysian; Gregory J. Vetter, Owatonna, both of Minn.

[73] Assignee: Truth Incorporated, Owatonna, Minn.

[21] Appl. No.: 411,098

[22] Filed: Sep. 22, 1989

[51] Int. Cl.[5] ..... E05F 11/28

[52] U.S. Cl. ..... 49/345; 49/252; 49/260; 49/279; 49/281

[58] Field of Search ..... 49/345, 339, 279, 280, 49/260, 248, 250, 252, 281

[56] References Cited

U.S. PATENT DOCUMENTS

| | | | |
|---|---|---|---|
| 27,119 | 2/1860 | Fay et al. . | |
| 1,471,736 | 10/1923 | Johnson . | |
| 1,640,459 | 8/1927 | Lee . | |
| 1,724,011 | 8/1929 | Flagg . | |
| 1,748,662 | 2/1930 | Stewart . | |
| 2,114,645 | 4/1938 | van Benschoten | 268/117 |
| 2,136,812 | 11/1938 | Carnahan | 268/117 |
| 2,366,613 | 1/1945 | Hagstrom | 268/120 |
| 2,538,980 | 1/1951 | Payne, Jr. | 268/75 |
| 2,784,459 | 3/1957 | Anderberg et al. | 49/248 |
| 2,905,464 | 9/1959 | Shaw, Sr. | 268/110 |
| 3,145,988 | 8/1964 | Colautti et al. | 268/3 |
| 3,154,302 | 10/1964 | Maruyama | 268/3 |
| 3,202,414 | 8/1965 | Simmons et al. | 268/3 |
| 4,392,330 | 7/1983 | Buhr | 49/260 X |
| 4,497,135 | 2/1985 | Vetter | 49/280 |
| 4,571,776 | 2/1986 | Taylor | 16/339 |
| 4,679,352 | 7/1987 | Bates | 49/192 |
| 4,726,092 | 2/1988 | Tacheny et al. | 16/364 |
| 4,860,493 | 8/1989 | Lense | 49/279 |

*Primary Examiner*—Philip C. Kannan

*Attorney, Agent, or Firm*—Wood, Phillips, Mason, Recktenwald & Vansanten

[57] ABSTRACT

A window operator and hinge structure for a casement window which can be simply factory pre-set for positioning of a window in either egress or wash modes, with switching between modes requiring no additional parts or special tools. The structure has a pivoted handle movable between a closed, inactive position flush with a sill cover and rotatable to an inclined, active position. The handle, in its pivoting movement, operates window locking structure and also controls the action of a brake, with release of the brake by raising of the handle to operative position. Motion-transmitting connections between the handle and linkage structure include the brake as well as the clutch, with the clutch effective to limit the torque that can be applied to the linkage. The handle can be moved to closed, inactive position with the window open so that no handle protrudes and this movement of the handle sets the brake so that a wind cannot move the window.

19 Claims, 5 Drawing Sheets

FIG. 2
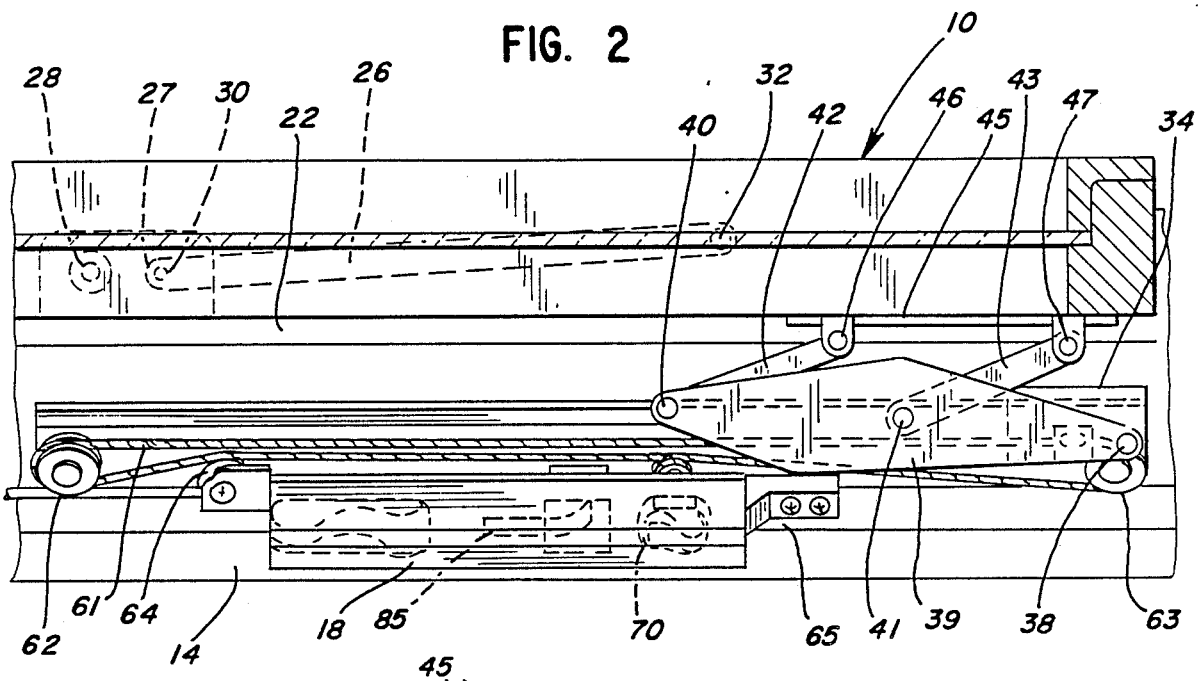
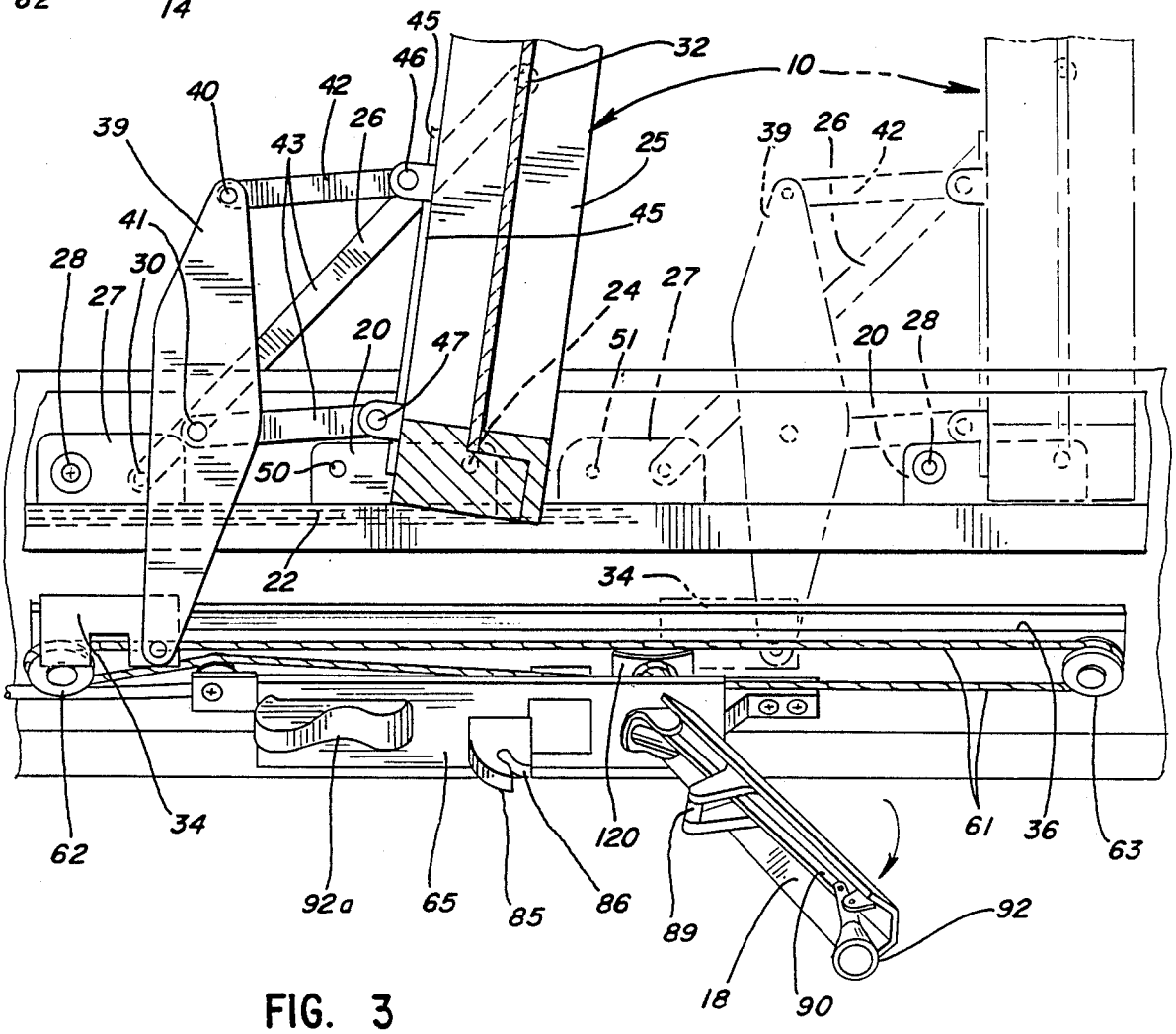
FIG. 3

92
93
91
76
100
86
85
70
89
88
110
18
84
87
90
96
95
66
92a
111
116
63
65
60
62
64
120
122

WINDOW OPERATOR AND HINGE STRUCTURE

BACKGROUND OF THE INVENTION

This invention pertains to a window operator and hinge structure which, operating in combination, enable positioning of a casement or awning window in either egress or wash positions without the use of additional parts or special tools. These different positions are obtainable by changing fixed and movable connections and rotation of a handle of the window operator. Additionally, the window operator has a handle that, in an inactive position, is stored flush with a sill cover for the window and that can be stored in such position even with the window open. The handle, in moving between a stored, inactive position and an active position, functions to automatically control the locking of the window sash of the window. The motion-transmitting connection from the handle to linkage structure connected to the window sash includes a brake which holds the window in closed as well as any open position. The brake is released by movement of the handle to active position. Also, a slip clutch in the connection limits the torque that can be transmitted from the handle to the linkage structure.

The Flagg U.S. Pat. No. 1,724,011 discloses a window operator and hinge structure wherein rotation of a handle will sequentially control locking and unlocking of the window and movement of the window sash.

The Vetter U.S. Pat. No. 4,497,135 shows window operator and window locking structure wherein a single prime mover operable through gearing can sequentially control the locking and unlocking of a window and movement of the window sash.

The Flagg and Vetter patents do not show a window operator and window locking mechanism wherein a handle, in moving from an inactive, storage position to an active position, operates to move a window locking structure to an unlocking position and to return the window locking structure to a locking position when the handle is moved back to an inactive storage position.

The window operator art also includes showings of chain or cable drives for achieving window movement, with this art including the Johnson U.S. Pat. No. 1,471,736, the Lee U.S. Pat. No. 1,640,459 and the Shaw U.S. Pat. No. 2,905,464, with the last-mentioned patent including a clutch in the drive train to assure against over-torquing the mechanism.

There have been previous efforts to provide for positioning of a casement window in either wash or egress positions. Variations in the length of elements of hinge structure to achieve this are shown in the Tacheny et al. U.S. Pat. No. 4,726,092. An extremely complex system to enable positioning of a casement window in either wash or egress positions as a result of rotation of a single handle is shown in the Bates U.S. Pat. No. 4,679,352.

Prior window operators and hinge structures have not provided for simple change of movable shoe connections of casement window hardware to provide either egress or wash positions, nor the locking and unlocking of a window under the control of a window operator handle which moves between a stored, inactive position and an inclined active position and, in such movement, operates the window locking mechanism. Further improvements over the prior art relate to the provision of a brake which can hold the window in closed or any open position and which is released upon movement of the handle to active position. The handle can be moved to a stored, inactive position in any open position of the window. The motion-transmitting connection between the handle and linkage structure for the window includes a slip clutch to limit the torque that can be applied thereto.

SUMMARY OF THE INVENTION

A primary feature of the invention is to provide a new and improved window operator and hinge structure.

Another feature of the invention is to provide a window operator and hinge structure having a handle flush with a sill cover for the window and which can be moved to an inclined, active position and which, in the process, releases a brake in a motion-transmitting connection between the window operator and linkage structure for the window, with the brake being effective to hold the window in any open position.

Another feature of the invention is to provide for the use of the handle to operate window locking structure during the movement of the handle between a stored, inactive position and an active position.

Another feature of the invention is to provide for positioning of the window in either a full open egress or full open wash position as may be required by a customer. The desired operation can be achieved by a simple change in the connection of structural components prior to shipment of the window. This substantially reduces window inventory.

An object of the invention is to provide a window operator for a window having a window frame with a sill cover and a movable window sash comprising, linkage means connectable between the window frame and window sash and operable to cause movement of the window sash, rotatable handle means, motion-transmitting means between the handle means and the linkage means, said rotatable handle means comprising a handle having an inactive position flush with the sill cover and an active position inclined relative to the sill cover, and a hand knob pivotally mounted to the underside of the handle adjacent an end thereof for storage beneath the handle when the handle is in inactive position and movable to an operating position when the handle is in said active position.

Another object of the invention is to provide a window operator as defined in the preceding paragraph which includes means for automatically moving the hand knob to the operating position as the handle moves to an active position, and wherein the motion-transmitting means includes a sheave rotatable about an axis with the handle having a pivot axis which is aligned with the sheave axis of rotation and the hand knob in operating position having an axis which is parallel to the sheave axis of rotation.

Still another object of the invention is to provide a window operator as defined in the preceding paragraphs including a window locking member with means operable by the handle to move the window locking member which comprises a rotatable cam engageable by a roller associated with the handle and which causes translation of an elongate member as the cam rotates to move the window locking member.

Another object of the invention is to provide a window operator and hinge structure for a casement or awning window comprising, a movable slider, links pivoted to said slider and connectable to a window sash for movement thereof as the slider moves, a rotatable handle having a closed position and an active position, motion-transmitting means between said rotatable handle and slider whereby handle rotation imparts movement to the slider, and said motion-transmitting means including a clutch and brake which are alternately operable dependent upon the rotatable handle being in either closed or active position.

An additional object of the invention is to provide a window operator and hinge structure as defined in the preceding paragraph wherein the operator has a base with a member fixed on the base having brake means, the motion-transmitting means has a sheave yieldably urged toward the member having the brake means, with brake means on the upper end of the sheave and clutch means on the upper end of the sheave with a movable clutch member positioned at the upper end of the sheave depressible to engage the clutch means and simultaneously cause the disengagement of the brake means by downward movement of the sheave.

An additional object of the invention is to provide window operator and hinge structure including slider and linkage structure associated with the window frame and the window sash and with the operator having a handle and motion-transmitting means extended to the slider and link structure whereby rotation of the handle causes movement of a window between open and closed positions, with the full open position being either an egress or wash position, dependent upon the release of a link and the locking of a slider in fixed position.

BRIEF DESCRIPTION OF THE DRAWINGS

FIG. 2 is a fragmentary plan view of the window operator and hinge structure, taken generally along the line 2—2 in FIG. 1, with the handle closed;

FIG. 3 is a view, similar to FIG. 2, showing the window in full line in fully open wash position and the handle in a raised, active position and also showing the window in a fully open egress position in broken line;

DESCRIPTION OF THE PREFERRED EMBODIMENT

Figure 1:
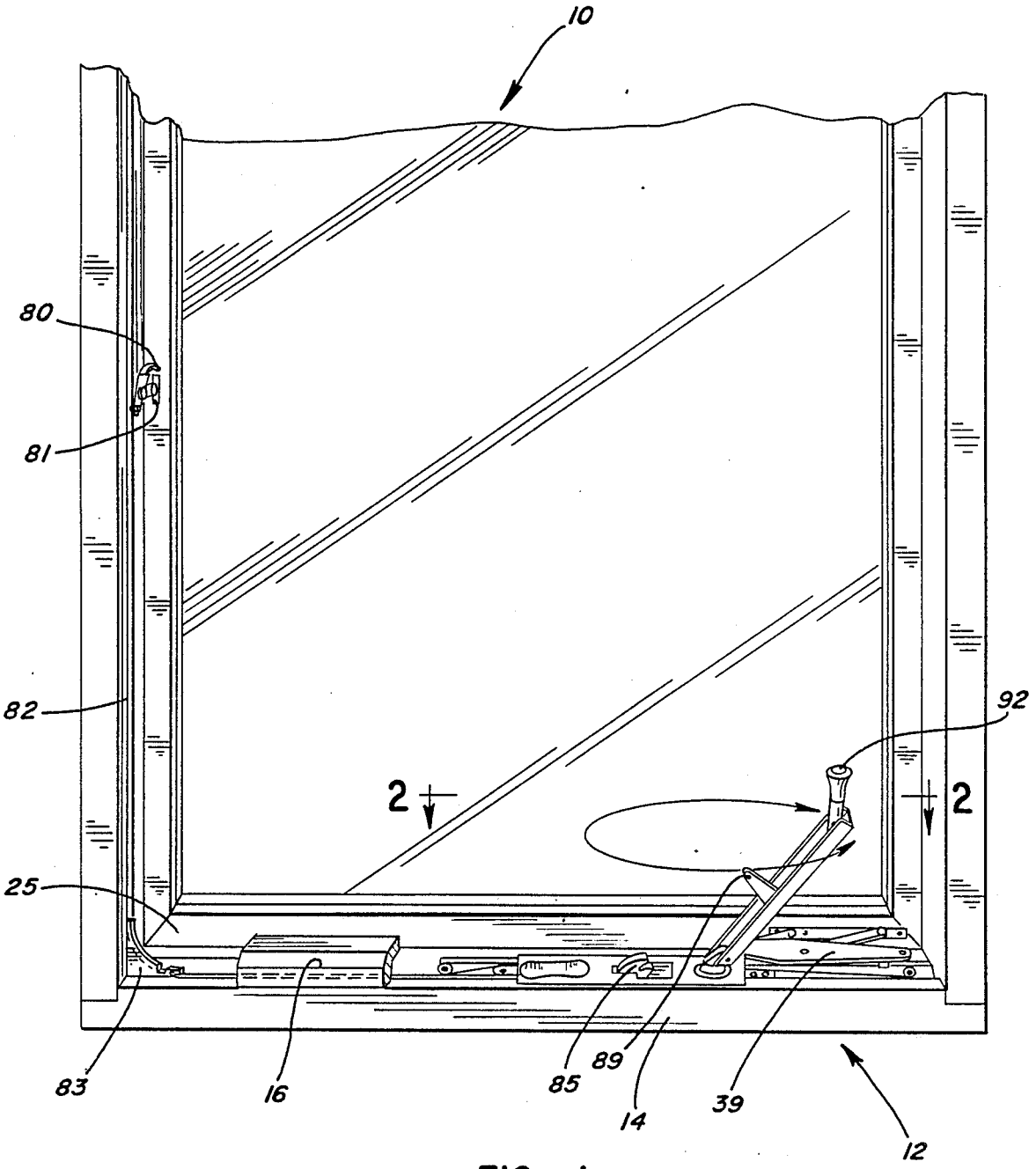
FIG. 1 is a fragmentary, generally elevational view, of a casement window having the window operator and hinge and also the locking structure associated therewith, and with a sill cover broken away and a handle of the window operator shown in raised, active position.

The window operator and hinge structure is shown in association with a casement window in FIGS. 1 to 3. It is within the scope of the invention to utilize the window operator and hinge structure with other types of pivoted windows, such as an awning window.

The casement window has a window sash, indicated generally at 10, movably fitted within a window frame, indicated generally at 12, and having a sill 14. A separate sill cover 16 overlies the sill 14 to permit access to and enclose operating mechanism. This sill cover 16 extends for the entire length of the sill except for a cut out intermediate its ends of a length adequate to enable a handle 18 to extend generally flush with the top of the sill cover when the handle is in a folded, storage position, as seen in FIG. 2.

The window operator and hinge structure provides for locking and unlocking of the window as well as for movement of the window sash between a closed position and either a fully open wash position or a fully open egress position. An egress position is made possible by changing the connection of a first shoe 20 to have it fixed, rather than slidably movable, and having a pivoted end of a link 26 freely movable along the sill, rather than fixed at a particular location on the sill. The window is shown closed in FIG. 2 and is shown in a full line wash position in FIG. 3 and a broken line egress position in the same Figure.

The handle 18 in addition to being rotatable to open and close the window also functions in movement between a folded, storage position and an inclined, operating position to control locking and unlocking of the window in a manner to be described.

The window operator and hinge structure includes a first shoe 20 (FIGS. 2 and 3) which can move in a path parallel to the length of the window sill 14. This path of movement is defined by a guide track 22 suitably secured to the upper face of the sill. The first shoe 20 has an interlocking fit with a shaped portion of the track whereby the first shoe is confined for movement along the track and can be assembled to the track by endwise insertion onto the track. The first shoe 20 pivotally mounts the window sash along a vertical edge thereof by means of a pivot pin 24 extending into the underside of the lower rail 25 of the window sash. In movement of the window sash to a fully open wash position, the shoe 20 moves from the position shown in FIG. 2 to the position generally shown in FIG. 3 in full line. The actual position shown in full line in FIG. 3 being slightly beyond the normal full open position where the window sash extends at a right angle to the window frame.

A second shoe 27 is in confined relation with the guide track 22 and, as shown in FIG. 2 and full line in FIG. 3, is secured against movement along the guide track by a threaded member 28 threaded into a planar part 29 of the guide track 22. The link 26 has an end 30 pivotally connected to the second shoe 27 and at opposite end pivotally connected at 32 to the bottom rail of the window sash. The fixed position of the second shoe 27 fixes the pivot point for link 26.

Motion is imparted to the window sash by linear movement of a slider 34 slidably mounted on a guide track 36 which extends lengthwise of the window sill 14 and is fixed thereto. The slider 34 and guide track 36 have interfitting shapes whereby the slider is locked to the guide track and can be assembled thereto by endwise insertion onto the guide track. The slider has a position at one end of the guide track 36, as shown in FIG. 2, when the window is closed and has a full travel position, shown in full line in FIG. 3, with resulting positioning of the window sash in full open wash position. The slider 34 has a pivot connection at 38 (FIG. 3) to one end of a link 39. The link 39 has pivot connections as 40 and 41 to a pair of spaced-apart links 42 and 43, respectively, which are pivotally connected to the lower rail 25 of the window sash. These pivot connections 46 and 47, respectively, are made to a bracket 45 secured to the lower rail of the window sash.

The slider 34 moves along the sill in a straight line from right to left as the window opens and the force applied at the pivot connection 38 to the link 39 is almost perfectly in line with the direction of translation throughout the movement of the window sash between fully open and closed positions. Forces perpendicular to the line of translation are nearly zero for all window positions. As the slider 34 moves toward the left to move the window sash to the full open wash position, a pull is exerted on the links 42 and 43 which, in coaction with the link 26 which is pivoted to the fixed second shoe 27, the window is caused to move outwardly as the first shoe 20 moves from right to left.

If the window is to have a fully open egress position, shown in broken line in FIG. 3, rather than a fully open wash position, the operation of first shoe 20 and second shoe 27 is changed. The screw 28 is removed from a hole 50 in the second shoe 27 to free this shoe for movement along the guide track 22. This screw is then used to secure the first shoe 20 in fixed position by insertion in a hole 50 and threading into the planar part 29 of the guide track, as shown in broken line in FIG. 3, the screw being identified at 28'. For the opening of the window to an egress position, the slider 34 moves from the position shown in FIG. 2 to the position shown in broken line in FIG. 3. This movement has caused the second shoe 27 to slide along the guide track 22. The only difference between fully open egress and wash positions is the amount of rotation required for the handle 18 and the amount of translation of the slide 34 along the guide track 36.

Movement of the slider 34 is derived from rotation of the handle 18 by motion-transmitting means including a sheave 60 having a cable 61 with multiple wraps extending therearound and fastened securely to the sheave. The cable 61 extends around a pair of pulleys 62 and 63 which are located approximately at the limits of travel of the slider 34 and travels past a guide pulley 64 as the sheave rotates.

The cable 61 is fixed to the slider 34 by a suitable connection (not shown).

The motion-transmitting means additionally include a clutch and brake structure with components thereof being associated with a base plate 65 attached to the sill 14, a clutch member 66, and the sheave 60.

The handle 18 is rotatably mounted relative to the base 65 by pivotal connection to a rotatable cap 70 which is constructed of two pieces including a lower lip section 71. The cap 70 is rotatably mounted in an opening 72 in the base 65 and is of two-part construction. The cap is rotatably captured on a flange 73 of the base by separate assembly of the major part of the cap and the lip section 71 into the associated relation shown in FIGS. 5 and 6 and then the parts are secured together to keep the cap rotatably captured to the base. The cap 70 has a pivot pin 74 which extends through an opening 75 in a link 76 for pivoting thereof. The link 76, at its opposite end, receives a pivot pin 77 which pivotally connects the link 76 to the underside of the handle 18. Pivoting of the handle 18 by means of the pivoted link 76 enables the handle 18 to move between the closed position, shown in FIG. 2, and the inclined, active position, shown in FIGS. 3 and 6.

In moving between the open and closed positions, the handle performs additional functions including the locking and unlocking action for the window by control of a locking member 80, seen in FIG. 1. The locking member 80 is pivoted on the window frame and coacts with a keeper 81 on the window sash. As known in the art, a flexible strap 82 can extend downwardly from the locking member and through a guide channel 83 at a lower corner of the window frame and terminate in a connection with a rod 84 which connects to a rotatable cam 85 having a cam slot 86. The cam 85 is movable within a recess 87 formed in the base 65 and is pivoted thereto by a pin extending through an opening 88 in the cam and fitted into recesses in the base 65.

Figure 4:
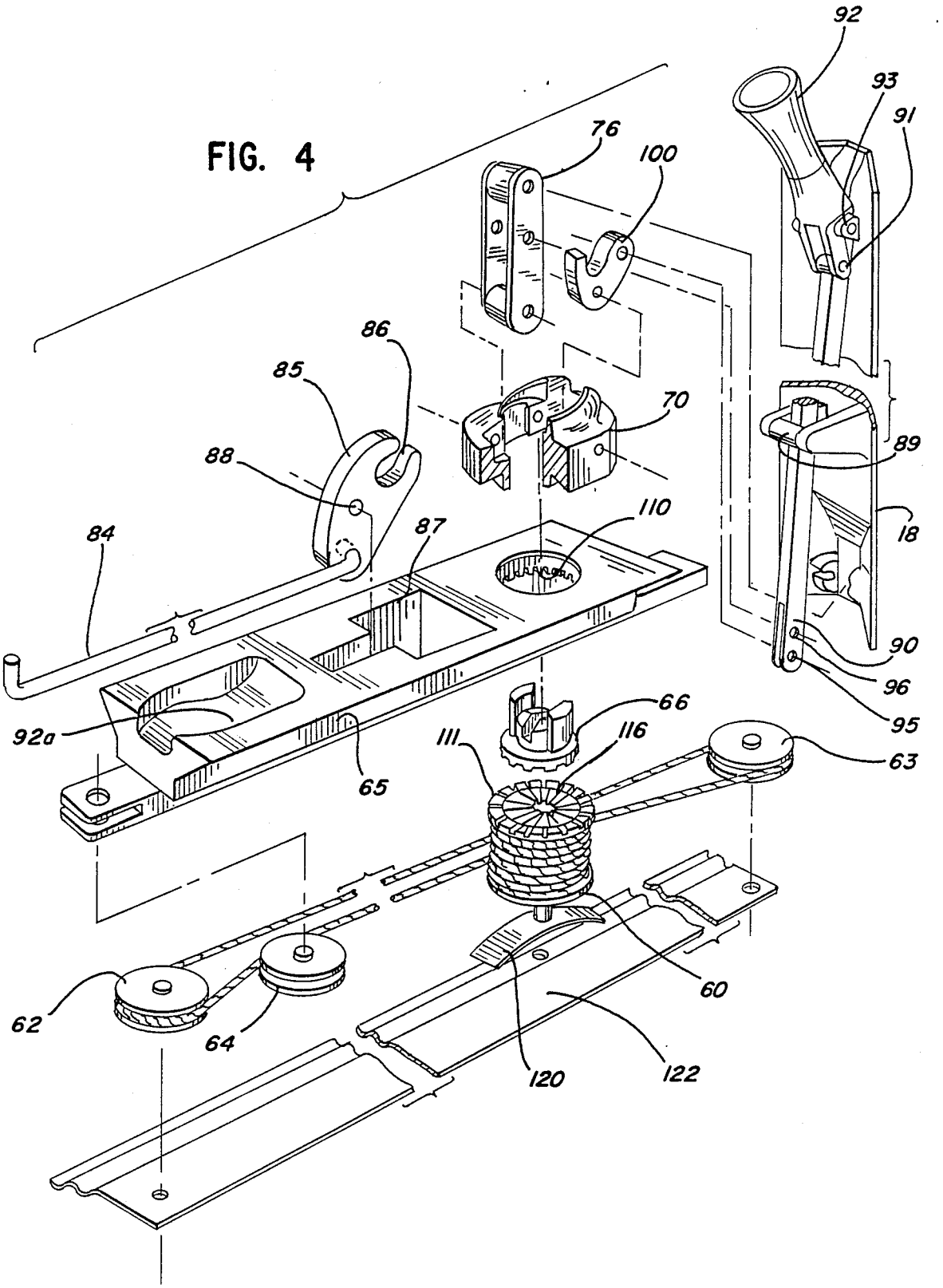
FIG. 4 is an exploded, perspective view of components of the window operator.

A roller 89 (FIG. 3) formed on the underside of the handle 18 coacts with the cam whereby, with the handle 18 closed, the roller 89 is within the cam slot 86 and has rotated the cam 85 clockwise into the recess 87, as viewed in FIG. 4, to extend the strap 82 upwardly and pivot the locking member 80 into locking position. If the window is closed to have the keeper 81 positioned for engagement by the locking member, the window is locked. However, if the window sash is open, there can be movement of the locking member without a locking action occurring. This enables movement of the handle to a closed, storage position flush with the sill cover even when the window is open. As the handle 18 moves upwardly to an active position, the roller moves along the cam slot 86 of the cam 85 and causes counterclockwise pivoting of the cam to cause downward movement of the strap 82 and release of the locking member from the keeper 81. Continued upward movement of the handle 18 to the fully open position causes the roller 89 to merely move out of the cam slot 86 so that the parts are positioned as seen in FIG. 1 and the handle is free to rotate.

An elongate link 90 is movably associated with the handle 18 and is located within a cavity defined by the general U-shape cross section of the handle. One end of the elongate link 90 is pivotally connected at 91 to a handle knob 92 which is pivoted to the underside of the handle at 93. The opposite end of the elongate link 90 has a bifurcated end with a pair of through openings 95 and 96. The through opening 96 has a pin 97 extending therethrough which extends through an opening in the handle-pivoting link 76. Through opening 95 has a pin 98 extended therethrough which pivotally connects into an opening formed in a cam 100 which is positioned within a central opening in the cap 70 and which is pivoted to the cap by a pin 101.

Figure 5:
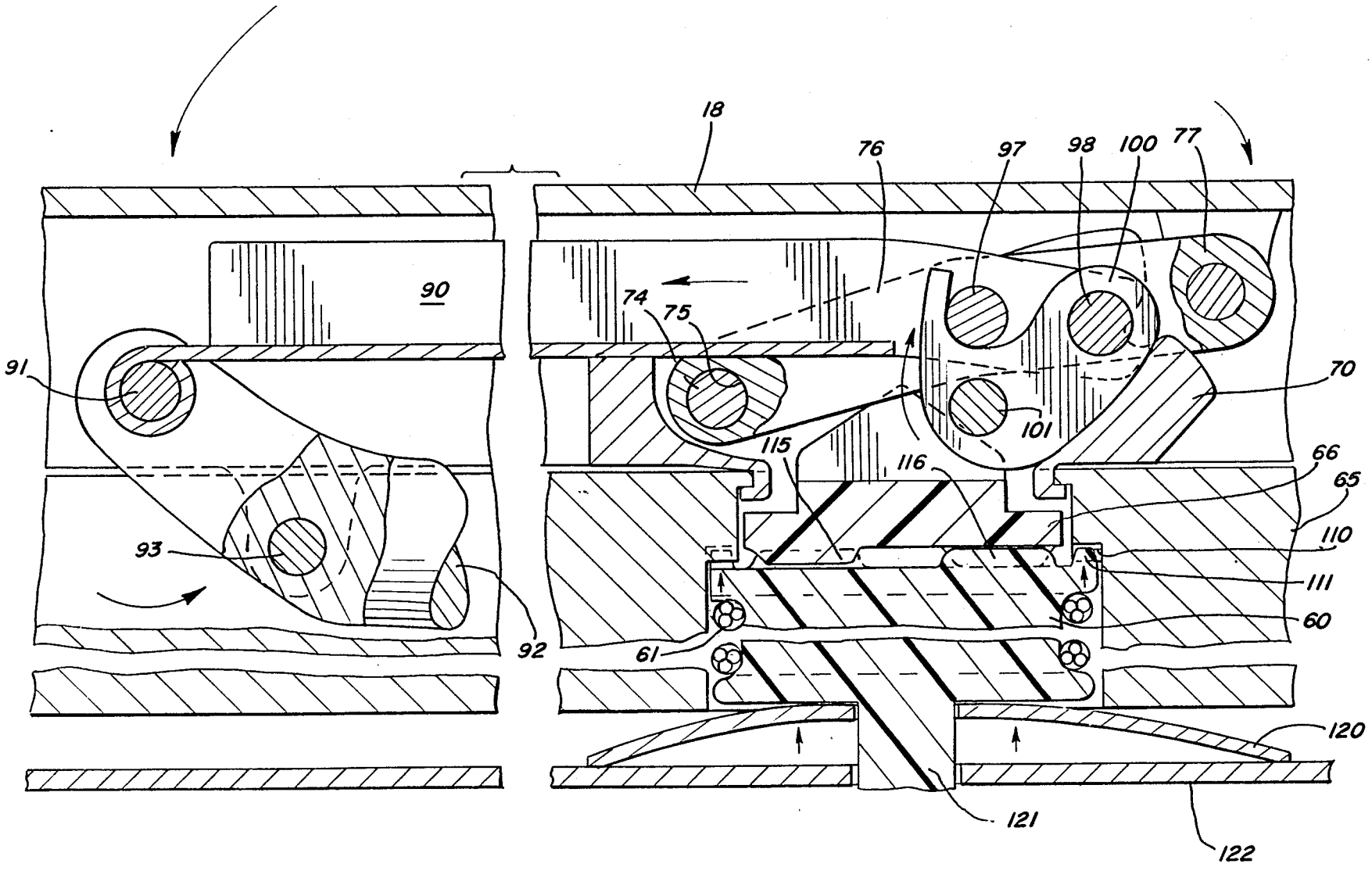
FIG. 5 is a central, vertical section on an enlarged scale with parts broken away of the handle and clutch and brake structure, with the handle shown in a closed position.
Figure 6:
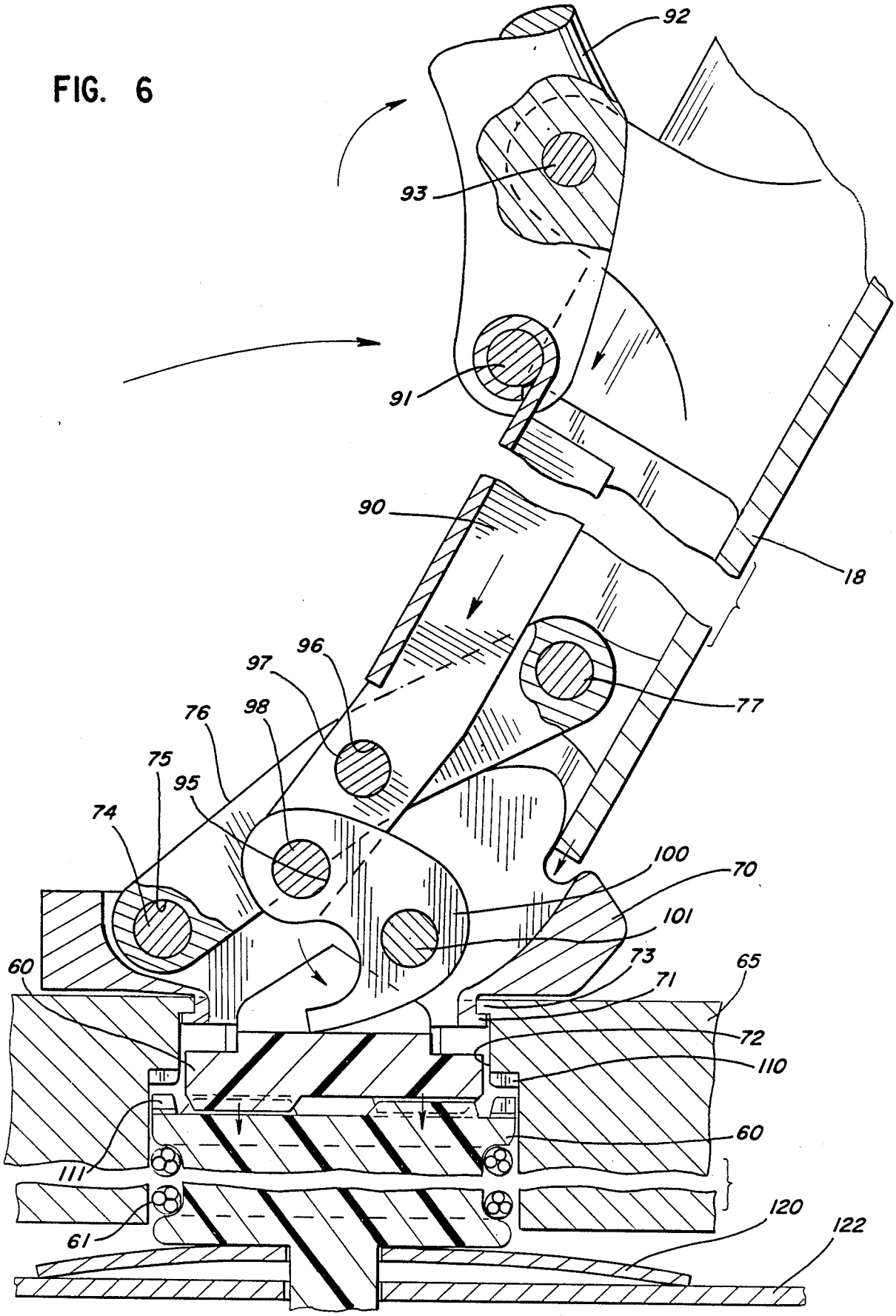
FIG. 6 is a view similar to FIG. 5 with the handle shown in raised active position and the brake released.

The cam 100 coacts with a clutch member 66. In one rotative position of the cam 100, the clutch member 66 is in an upper position, as seen in FIG. 5, and, in another rotative position of the cam 100, the clutch member 66 is in a lowered operative position, as seen in FIG. 6. The rotative position of the cam 100 is automatically controlled by the position of the handle 18. This is because of the handle and link structure, in effect, defining a six-bar linkage.

With the handle 18 in closed, inactive position, the handle knob 92 is stored within the cavity of the handle 18 and a recess **92*a* in base 65 and, as the handle 18 is raised to its inclined, active position, the action on the elongate link 90 causes rotation of the cam 100 to depress the clutch member 66** and pivoting of the handle knob to operating position.

In depressing the clutch member, there is automatic release of a brake forming part of the motion-transmitting means. This structure is seen particularly in FIGS. 4 to 6 wherein the base 65, clutch member 66, and sheave 60 have the clutch and brake structure. The brake structure comprises a series of downwardly-depending brake teeth 110 surrounding the opening 72 of the base and which coact with an annular series of brake teeth 111 on the upper face and at the outer periphery of the sheave 60. The brake teeth are shown engaged in FIG. 5 and disengaged in FIG. 6. The clutch includes a series of inclined teeth 115 formed on the underside of the clutch member 66 and an upwardly-extending series of mating inclined teeth 116 on the upper face of the sheave. These teeth are in engagement, as seen in FIGS. 5 and 6, but are only effective as a clutch when the clutch member 66 is in the lowered position of FIG. 6 to depress the sheave 60 and release the engagement between the brake teeth 110 and 111. The teeth can disengage during overtorque and when the handle is not in the full open position.

With the handle 18 in the raised, active position, the cam 100 is rotated to the position shown in FIG. 6 and, with frictional engagement with the upper side of the clutch member 66, the handle is retained in raised position and the clutch member 66 is lowered to depress the sheave 60 and disengage the brake teeth and enable transmittal of drive through the clutch.

The upper end of the clutch member 66 has a central recess, as most clearly seen in FIG. 4, whereby the cam 100 can operate within the recess for controlling the elevation of the clutch member.

The sheave 60 which is rotatable in the base opening 72 and clutch member 66 are urged upwardly, as seen in FIGS. 4 to 6, by means of a leaf spring 120 having a central opening fitted on a downward, central projection 121 of the sheave 60 and coacting with a plate 122 positioned between the sill 14 and the base 65. As the cam 100 rotates from the position of FIG. 5 to the position of FIG. 6, the clutch member 66 and the sheave 60 are urged downwardly against the force of the spring 120. The clutch means provides for limiting of torque that can be applied to the operating mechanism, while the brake is effective to hold the window closed or in any desired open position. With the handle 18 in raised, operative position, the brake is not effective, but the handle can be closed at any time and, when closed, cam 100 automatically rotates to a position to permit elevation of the clutch member 66 and the sheave 60 whereby brake teeth 110 and 11; enter into engagement to lock the mechanism against movement.

When there is excess torque exerted on the mechanism by rotation of the handle 18, the inclined teeth of the clutch merely ratchet over each other with depression of the sheave 60 against the spring 120.

From the foregoing description, it is believed the operation will be entirely clear. The operation may be generally summarized as follows:

With the window closed, as seen in FIGS. 1 and 2, handle 18 is raised from the closed position, shown in FIG. 2, to the inclined active position, shown in FIGS. 1 and 3. As the handle is raised, the roller 89 on the underside thereof causes rotation of the cam 85 to translate the strap 82 and pivot the locking member 80 out of locking relation with the keeper 81. Through the linkage connections shown in FIGS. 4 to 6, the handle knob 92 is caused to move to an operative position wherein its axis extends parallel to the axis of rotation of the sheave 60. The handle 18 pivots about an axis which overlies the axis of the sheave 60 which defines an axis of rotation for the handle 18.

With the screw 28 holding the second shoe 27 in fixed position for movement of the window to a fully open wash position, rotation of the handle (due to the brake being released by the handle being fully open) causes translation of the slider 34 by movement of the cable 61. The slider 34 acts on the link 39 to cause movement of the links 26, 39, 42 and 43 from the position of FIG. 1 to the position of FIG. 3.

If the window hardware is factory pre-set for movement of the window sash to a fully open, egress position, rather than a wash position, the second shoe 27 is free to move and the screw 28 is used as shown at 28' to hold the first shoe 20 against movement whereby movement of the slider 34 to the broken line position in FIG. 3 causes full open position of the window.

With the window partially or fully open, the handle 18 can be pivoted downwardly to its closed, inactive position of FIG. 2 which sets the brake and holds the window in the desired position against the forces of wind or other forces. This closed position is permitted by coaction between roller 89 and the cam 85 with translation of the window locking strap 82 but without any locking action since the window is open.

We claim:

1. A window operator for a window having a window frame with a sill cover and a movable window sash comprising, linkage means connectable between the window frame and window sash and operable to cause movement of the window sash, rotatable handle means, motion-transmitting means between the handle means and the linkage means, said rotatable handle means comprising a handle having an inactive position flush with the sill cover and an active position inclined relative to the sill cover, and a hand knob pivotally mounted to the underside of the handle adjacent an end thereof for storage beneath the handle when the handle is in inactive position and movable to an operating position when the handle is in said active position.

2. A window operator as defined in claim 1 including means for automatically moving said hand knob to said operating position as the handle moves to said active position.

3. A window operator as defined in claim 2 wherein said means for automatically moving the hand knob to operating position comprises a link mounted on said handle for lengthwise movement and having opposite ends with one end pivotally connected to said hand knob and the other end connected to a part of the operator which precludes substantial lengthwise movement of said link as the handle is raised whereby relative movement between said link and the handle causes said hand knob to move to operating position.

4. A window operator as defined in claim 2 wherein said handle is generally U-shaped in cross section with downwardly-extending side walls defining a cavity therebetween, and said hand knob being stored in said cavity.

5. A window operator as defined in claim 1 wherein said motion-transmitting means includes a sheave rotatable about an axis, and said handle having a pivot axis which is aligned with the sheave axis of rotation.

6. A window operator as defined in claim 5 wherein said hand knob in operating position has an axis which is parallel to the sheave axis of rotation.

7. A window operator as defined in claim 1 including a movable window locking member, and means operable by said handle to move said window locking member to locking position as the handle moves from active position to an inactive position.

8. A window operator as defined in claim 7 wherein the means operable by the handle to move the window locking member comprises a rotatable cam and an elongate member which translates as the cam rotates and a member on the underside of the handle which coacts with said cam.

9. A window operator as defined in claim 8 wherein said window operator has a base, said cam has a slot and the member on the underside of the handle is a roller, said cam and roller being constructed and arranged to have the roller move out of the cam slot as the handle moves away from the base toward active position whereby the handle is free to rotate when in active position.

10. A window operator as defined in claim 7 wherein said means to move the window locking member includes first and second members one on the handle and one on a base of the window operator, said members being disengaged when the handle is in active position and engaged when the handle is in closed inactive position regardless of whether the window is open or closed.

11. A window operator as defined in claim 1 wherein the motion-transmitting means includes a clutch and a brake, and means responsive to the position of the handle to establish which of the brake and clutch shall be operative with the brake operative when the handle is in closed inactive position and the clutch operative when the handle is in active position.

12. A window operator and hinge structure for a casement or awning window comprising, a movable slider, links pivoted to said slider and connectable to a window sash for movement thereof as the slider moves, a rotatable handle having a closed position and an active position, motion-transmitting means between said rotatable handle and slider whereby handle rotation imparts movement to the slider, and said motion-transmitting means including a clutch and brake which are alternately operable dependent upon the rotatable handle being in either closed or active position.

13. A window operator and hinge structure as defined in claim 12 including a base, a member fixed on said base having brake means, said motion-transmitting means having a sheave yieldably urged toward said member, brake means on the upper end of the sheave for engagement with the brake means on the member, clutch means on the upper end of the sheave, and a movable clutch member with clutch means at the upper end of the sheave depressible to engage the clutch means and move the sheave downwardly to disengage the brake means.

14. A window operator and hinge structure as defined in claim 13 wherein means interconnects said handle and clutch member to depress the clutch member as the handle is moved to active position.

15. A window operator and hinge structure as defined in claim 13 wherein the brake means on said member and said sheave are coacting teeth and the clutch means on the clutch member and sheave are coacting slanted teeth.

16. A window operator and hinge structure as defined in claim 15 wherein said member has a recess, said sheave being rotatably and translatably mounted in said recess, and a spring between the base and the sheave urging said sheave upwardly in said recess in a direction to engage the brake means and yieldable as the sheave is urged downwardly by depressing of the clutch member, said sheave moving further downwardly against said spring if there is excessive torque upon rotation of the handle which causes slippage of the coacting slanted teeth of the clutch means.

17. A window operator and hinge structure for a casement or awning window having a frame and a window sash comprising, a first track mountable on the sill of the window frame and parallel to the plane of a closed window sash, a slider movable along said first track, a second track, first and second shoes on said second track, a link having opposite ends with one end pivotally connectable to the second shoe and the other end pivotally connected to said window sash, means pivotally connecting the window sash to the first shoe, link means for interconnecting said slider and the window sash including a first link pivoted at an end to said slider, second and third links pivoted at one of their ends to said first link at spaced-apart locations and at their other ends pivotally connectable to the window sash at spaced locations, the link means being constructed and arranged whereby movement of the slider away from one end of the first track causes the first link to move from a position generally paralleling the track toward a position generally perpendicular thereto and with the second and third links extending generally perpendicular to the window sash when the window sash is fully open.

18. A window operator and hinge structure as defined in claim 17 wherein said window can be factory pre-set for movement of the window sash to either of two fully open positions further comprising means for selectively holding one or the other of the first and second shoes against movement while the other shoe is free to move.

19. A window operator and hinge structure as defined in claim 18 wherein each of said shoes is slidably mounted on the second track, and said selective holding means comprises a threaded member which can be associated with either one of said shoes to lock the associated shoe to the window frame and prevent movement thereof along the second track while the other shoe is free to move along the second track.

* * * * *